US005362166A

United States Patent [19]

Yamamoto et al.

[11] Patent Number: 5,362,166

[45] Date of Patent: Nov. 8, 1994

[54] FLAT STICK-SHAPED MATERIAL PROPELLING CONTAINER

[75] Inventors: Tadashi Yamamoto; Shuhei Kageyama, both of Kawagoe, Japan

[73] Assignee: Kotobuki & Co., Ltd., Kita, Japan

[21] Appl. No.: 83,684

[22] Filed: Jun. 28, 1993

[51] Int. Cl.[5] ..... B43K 21/22; B43K 21/02

[52] U.S. Cl. ..... 401/93; 15/433; 401/94

[58] Field of Search ..... 401/94, 93; 15/433, 15/434

[56] References Cited

U.S. PATENT DOCUMENTS 3,854,825 12/1974 Girella ..... 401/94
4,856,693 8/1989 Kageyama et al. ..... 401/94 X

FOREIGN PATENT DOCUMENTS 808028 7/1951 Germany ..... 401/94
12630 1/1956 Germany ..... 401/94
264327 1/1950 Switzerland ..... 401/94
457589 12/1936 United Kingdom ..... 401/94

*Primary Examiner*—Steven A. Bratlie
*Attorney, Agent, or Firm*—David O'Reilly

[57] ABSTRACT

A stick-shaped material propelling container comprised of a flat-shaped outer sleeve, a chuck in the form of tweezers having a pair of opposing flat arms inserted into the outer sleeve and having a base in the rear portion thereof, and a chuck ring connected to the front portion of the outer sleeve and positioned around the front portion of the chuck. A through hole is formed through the base of the chuck in a direction perpendicular to a longitudinal direction thereof, and a retaining portion is formed on an inner surface of the outer sleeve. An elastic member is mounted between the rear inner surface of the through hole and the retaining portion of the chuck.

10 Claims, 4 Drawing Sheets

FLAT STICK-SHAPED MATERIAL PROPELLING CONTAINER

BACKGROUND OF THE INVENTION

1. Field of the Invention

The present invention relates to a stick-shaped material propelling container for selectively extending and retracting stick-shaped materials, such as a stick-shaped eraser, lead, crayon stick, pastel stick, eyebrow stick and others, particularly flat stick-shaped materials.

2. Description of the Prior Art

The applicant has proposed a stick-shaped material propelling container in Japan applications for utility model registration No. 26097 of 1987 and No. 82841 of 1989.

Stick-shaped material propelling containers disclosed in the Japan applications for utility model registration No. 26097 of 1987 and utility model registration No. 82842 of 1989 comprise an outer sleeve, an inner sleeve slidably inserted into the outer sleeve, a spring mounted between the outer sleeve and the inner sleeve to axially spring-load the outer sleeve and the inner sleeve, and a chuck mounted on the front end portion of the inner sleeve. The above-mentioned containers are costly because of the cost of the inner sleeve, and can not be adapted for flat stick-shaped materials.

Further, in application for utility model registration No. 82841 of 1989, structures for mounting springs in the stick-shaped material propelling container are shown. For example, one structure disclosed has springs that are mounted between steps formed in the rear portion of the inner sleeve and opposed portions of the outer sleeve. Another structure disclosed has springs that are mounted between protruding parts formed in the rear portion of the outer sleeve and rear inner surfaces of cavities formed in the rear portion of the inner sleeve. Still another structure disclosed has springs that are mounted between protruding parts formed in the rear portion of the outer sleeve and a rear inner surface of a long hole bored through a rear portion of the inner sleeve. However, these structures are complicated, and the springs cannot be easily attached to the stick-shaped material propelling container. Further, it is necessary desirable to divide the outer sleeve into two parts.

BRIEF SUMMARY OF INVENTION

It is an object of the present invention to provide a stick-shaped material propelling container in which an inner sleeve is not required and which can be formed into a structure adapted for use with flat stick-shaped materials.

The above-mentioned object is, according to the present invention, achieved by a stick-shaped material propelling container comprising an outer sleeve, a chuck inserted in the outer sleeve having a base in the rear portion thereof, a chuck ring attached to the front portion of the outer sleeve positioned around the front portion of the chuck. A through hole formed through the base of the chuck extends in a direction perpendicular to a longitudinal direction of the chuck. At least one retaining portion is formed on the inner surface of the outer sleeve, and an elastic member is mounted between the rear inner surface of the through hole and the retaining portion.

In the present invention, the chuck preferably includes a knocking part formed in the base of the chuck.

Further, in the present invention, the outer sleeve has at least one elastic member guiding and receiving groove formed on the inner surface of a rear portion of the outer sleeve, with the groove having a front end acting as a retaining part. The groove guides the elastic member inserted into the through hole so that the front end of the elastic member is guided toward the retaining portion.

Further, in the present invention, the chuck may be in the form of long tweezers, adapted for holding flat stick-shaped materials.

Further, in the present invention, the protruding portion may be formed on the inner surface of the outer sleeve, and a projecting portion with a tapered surface formed on the inner surface of the chuck. A front end portion of the chuck is inserted into the chuck ring as the chuck is bent inward when the tapered surface of the projection portion is pushed inward by the protruding portion so that the projecting portion can pass over the protruding portion. Once the projecting portion passes over the protruding portion, the chuck is restored so that the projecting portion is prevented from slipping out of the outer sleeve over the protruding portion.

Still further, in the present invention, preferably, at least one projection is formed on the inner surface of the outer sleeve, and at least one hole into which said projection can be inserted is formed on the chuck ring so that the chuck ring can be restrictably slidably attached to the outer sleeve. Alternatively, at least one C-shaped slot may be formed on a surface of the outer sleeve. The C-shaped slot defines an elastic strip on an inner surface of which a projection is formed. In addition, at least one hole, into which the projection can be inserted, is formed on the chuck ring so that the chuck ring can be restrictably, slidably attached to the outer sleeve.

In the present invention, an outer sleeve, a chuck, and a chuck ring have flat sided shapes respectively so that a stick-shaped material propelling container is adapted for use with flat, stick-shaped materials.

As above-mentioned, according to the present invention, the inner sleeve necessary in the prior art is not needed. Further, when mounting the elastic member in the stick-shaped material propelling container, the elastic member is first inserted between the front inner surface and the rear inner surface of the through hole of the chuck. The chuck with the elastic member is then inserted into the rear end of the outer sleeve, from the side of a grip at the front portion of the chuck. The elastic member inserted together with the chuck is guided by the elastic member guiding and receiving groove. Accordingly, the elastic member can be easily inserted between the retaining portion and the rear inner surface of the through hole, while the chuck can be easily mounted into the outer sleeve and the chuck ring.

Further in the present invention, only one elastic member is needed.

Other objects and advantages of the invention will become more apparent from the following portion of this specification and from the accompanying drawings.

BRIEF DESCRIPTION OF THE DRAWING

In the drawings:

FIG. 2(*a*) being a vertical section thereof, and FIG. 2(*b*) being a right side view thereof;

FIG. 5(*b*) is a vertical sectional view of the outer sleeve of the embodiment of FIG. 5(*a*).

DETAILED DESCRIPTION

Figure 1:
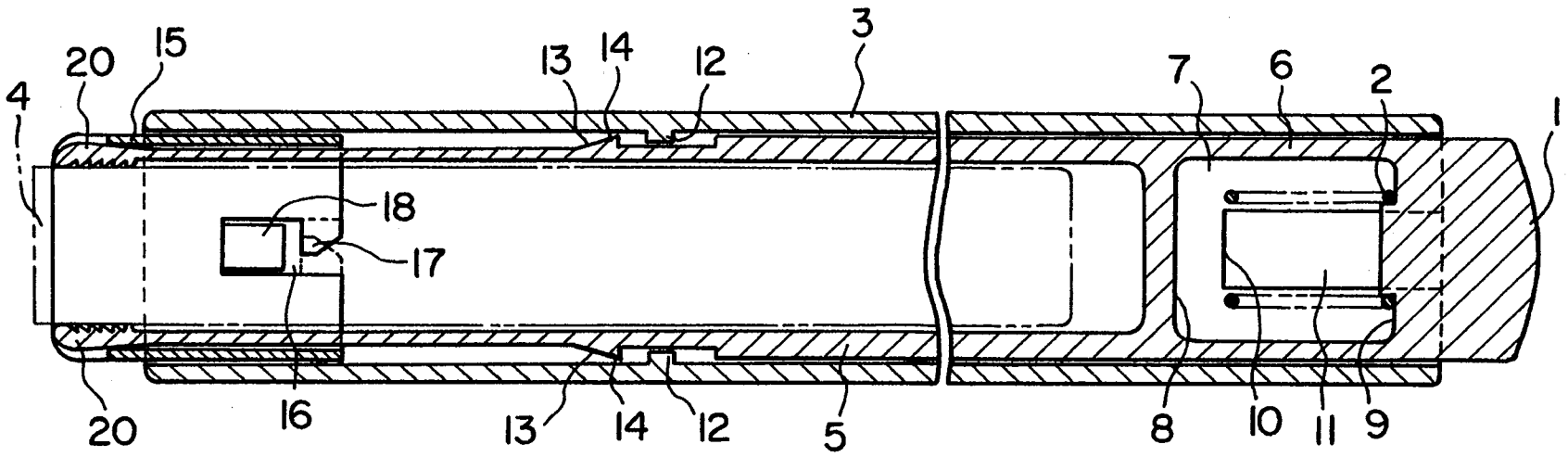
FIG. 1 is a cross-sectional view of one embodiment of a stick-shaped material container according to the present invention.
Figure 2A:
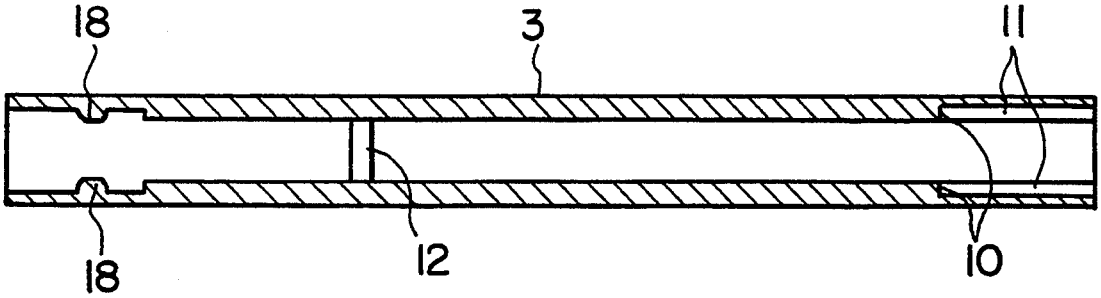
FIGS. 2(*a*), (*b*) show an example of an outer sleeve for the stick-shaped material propelling container of the present invention.
Figure 2B:
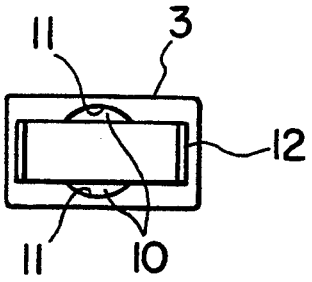

Referring to FIG. 1 the embodiment of the present invention shogun comprises a flat-shaped outer sleeve 3 (a vertical section thereof being shown in FIG. 2(*a*) and a right side view thereof being shogun in FIG. 2(*b*) ) and a flat-shaped chuck ring 15. Chuck ring 15 is provided with engaging holes 16 and stoppers 17 on the upper side and lower side thereof, respectively. Upper and lower projections 18 formed in the front portion of outer sleeve 3 (shown in FIG. 2(*a*) ) are inserted into upper and lower holes 16 of chuck ring 15 from the side of stoppers 17 by which chuck ring 15 is restrictably slidably attached to the front portion of outer sleeve 3. Once chuck ring 15 is attached to the front portion of outer sleeve 3, chuck ring 15 is prevented from slipping out of outer sleeve 3 by stoppers 17 so that the connection of chuck ring 15 with the front portion of the outer sleeve 3 is maintained.

Chuck 5 is in the form of long tweezers. Base 6 formed on the rear portion of chuck 5 is provided with through hole 7 for holding an elastic member which extends in a direction meeting at right angles with a longitudinal direction of chuck 5; that is in a vertical direction thereof (see FIG. 3). An elastic member or spring 2 is mounted between the rear inner surface 9 of through hole 7 and retaining portions 10 which are the ends of upper and lower elastic member guiding and receiving grooves 11 formed in the rear portion of outer sleeve 3 (see FIGS. 2 (*a*), (*b*) ).

Outer sleeve 3 is provided with left and right protruding ridge portions 12 about the central portion of outer sleeve 3, while chuck 5 is provided with projecting catch portions 14 with tapered surface 13 on the outer surface of chuck 5. Protruding ridge portions 12 prevent chuck 5 from slipping out of outer sleeve 3.

Figure 3:
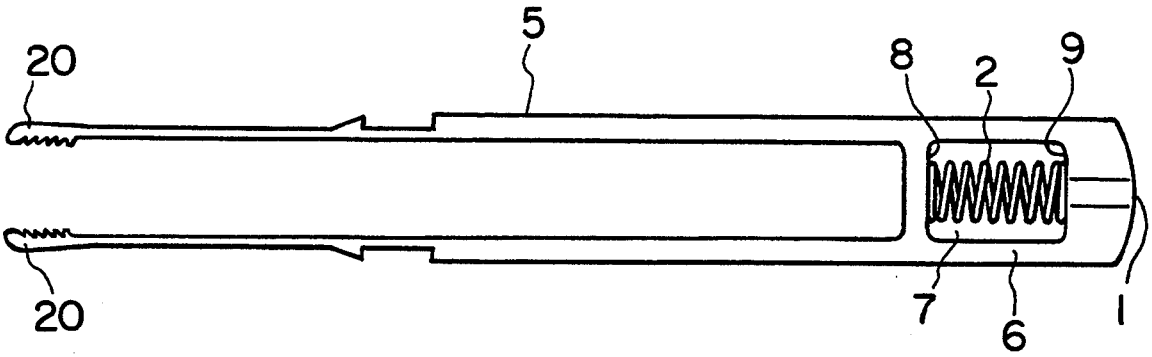
FIG. 3 is a plan view of a chuck with an elastic member for the stick-shaped material propelling container of the present invention.

The attachment of chuck 5 and spring 2 is carried out as follows. As shown in FIG. 3, first, spring 2 is set between the front inner surface 8 and the rear inner surface 9 of through hole 7. Chuck 5 is then inserted into the rear end of outer sleeve 3 from the side of grip 20 formed at the front end portion. Chuck 5 is pushed into outer sleeve 3 and spring 2 fits into and is guided by the elastic member guiding and receiving grooves 11. The front end portion of chuck 5 is inserted chuck ring 15 attached to the front portion of outer sleeve 3 as chuck 5 bends inward. Tapered surface 13 of projecting portion 14 is pushed inward by the protruding portion 12 until projecting catch portion 14 passes over and catches protruding ridge portion 12. Once projecting portion 14 passes over protruding ridge portion 12, chuck 5 is restored so that projecting catch portion 12 is prevented from slipping out of outer sleeve 3 by catching protruding ridge portion 12, while spring 2 is mounted between retaining portion 10 and rear inner surface 9 of through hole 7.

Thereafter chuck 5 is opened and closed by pushing and releasing knocking portion 1 formed at the rear end of chuck 5. While chuck 5 is kept opened, a flat stick-shaped eraser 4 may be set into chuck 5 from the front end.

It is apparent that stick-shaped eraser 4 can be inserted from the rear end of the chuck 5 and set into the chuck 5, by making the internal dimension of the spring 2 larger and forming longitudinal openings in the front inner surface 8 and rear inner surface 9 of through hole 7.

While outer sleeve 3 is hand held, knocking portion 1 may be knocked so that chuck 5 is moved against the force of spring 2 or with the spring force thereof to selectively open and close grip 20 of chuck 5 in response to the relative motion with chuck ring 15, causing stick-shaped eraser 4 to be extended from the front end of outer sleeve 3.

When the front end extended portion of stick-shaped eraser 4 is consumed, another portion of the stick-shaped eraser can be extended from outer sleeve 3 by the amount used. When retraction of stick-shaped eraser 4 into outer sleeve 3 is desired, the front end of stick-shaped eraser 4 can be pushed into the outer sleeve 3 with grip 20 of chuck 5 open by pushing knocking portion 1 a stroke equal to or more than the usual knocking stroke against the force of spring 2.

According to the present invention, since spring 2 is inserted between retaining portions 10 of outer sleeve 3 and rear inner surface 9 of through hole 7 of chuck 5, an inner sleeve necessary in the above-mentioned prior art is not needed. Therefore, the cost of the stick-shaped material propelling container can be reduced, and it becomes possible to provide a stick-shaped material propelling container adapted for flat stick-shaped material 4. Further, when attaching spring 2 in the stick-shaped material propelling container, spring 2 is set between front inner surface 8 and rear inner surface 9 of through hole 7 of chuck 5. Chuck 5 with spring 2 is inserted into the rear end of outer sleeve 3, grip 20 end first, by which spring 2 is guided by the elastic member guiding and receiving grooves 11 of outer sleeve 3. Spring 2 can be inserted together with chuck 5 so that spring 2 can be easily inserted between retaining portion 10 and rear inner surface 9 of through hole 7, and chuck 5 can also be easily mounted into outer sleeve 5 and chuck ring 15. Further chuck 5 can be positively prevented from slipping out of outer sleeve B by protruding ridge portion 12 engaging projecting catch portion 14.

Further, the stick-shaped material propelling container according to the present invention has a simpler structure as compared with the stick-shaped material propelling container disclosed in Japan application for utility model registration No. 82841 of 1989, and only one spring 2 is needed. Therefore the cost of the stick-shaped material propelling container can be reduced by the cost of the needless spring, and the attachment of spring 2 can be easily and certainly made. Further, in the present invention, it is unnecessary to divide outer sleeve into parts.

Figure 4:
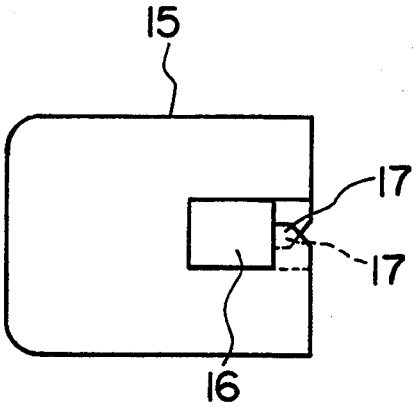
FIG. 4 is a plan view of a chuck ring for the stick-shaped material container of the present invention.
Figure 5A:
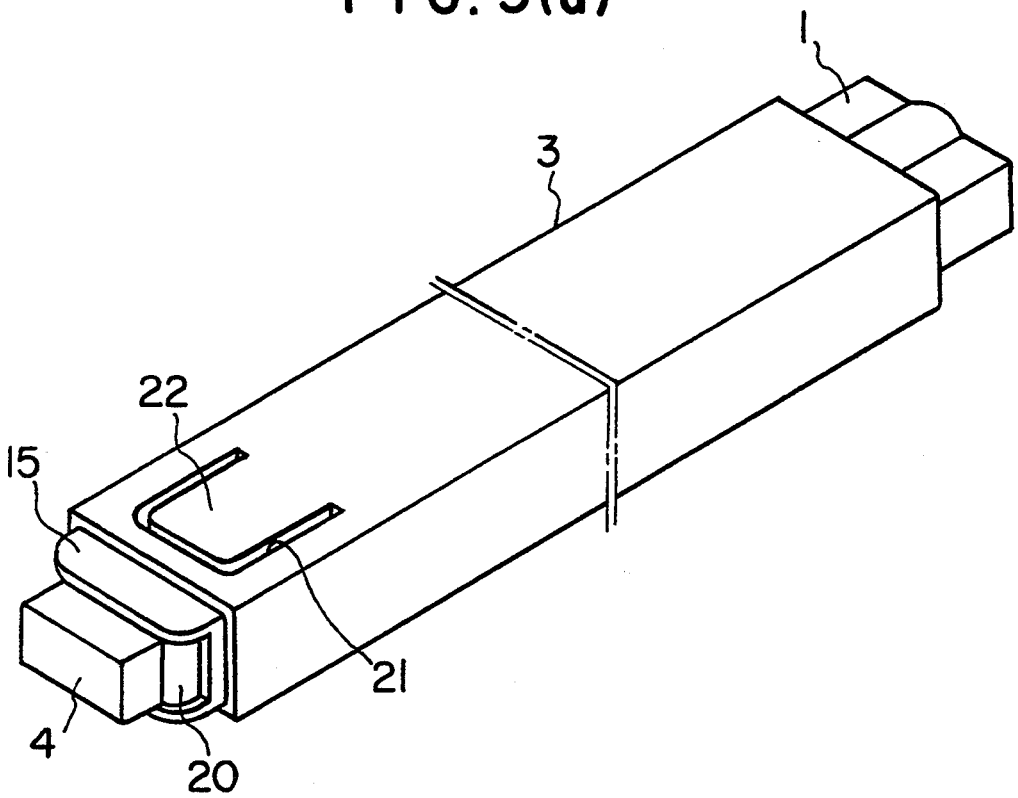
FIG. 5(*a*) is a perspective view of another embodiment according to the present invention.
Figure 5B:
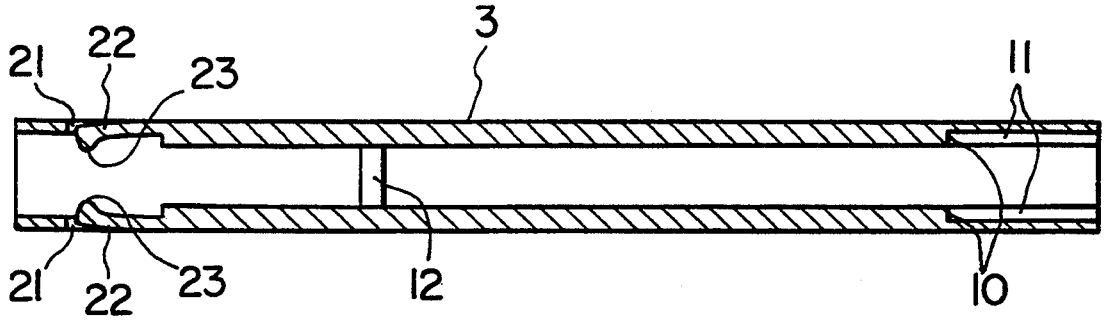

FIGS. 5(*a*) and (*b*) show another embodiment of the stick-shaped material propelling container. Outer sleeve 3 has a pair of C-shaped slots 21,21 on upper and lower sides thereof which define deformable elastic strips 22,22, respectively. Projections 23,23 are formed at the inner ends of each deformable elastic strip 22,22. When attaching chuck ring 15 to the outer sleeve 3, elastic strips 22,22 are pressed outwardly away from each other by chuck ring 15 until projections 23,23 engage upper and lower holes 16,16 of chuck ring 15 (FIG. 4). Chuck ring 15 can then be restrictably slidably attached to outer sleeve 3 and prevented from slipping out of outer sleeve 3 by stoppers 17,17.

While the principles of the invention have been described above in connection with specific embodiments, and particular modifications thereof, it is to be clearly understood that this description is given only by way of example and not as a limitation on the scope of invention.

What is claimed is:

1. A stick-shaped material propelling container comprising; a flat-shaped outer sleeve; chuck means in the form of flat-sided long tweezers having a pair of elongated flat-shaped arms inserted in said flat-shaped outer sleeve; said chuck means having a forward grip portion and a rear base portion and a knocking portion on said chuck rear base portion; a chuck ring connected to a forward end of said outer sleeve, said chuck ring connected to a forward end of said outer sleeve, said chuck ring surrounding said forward grip portion; an opening formed in said rear base portion perpendicular to the longitudinal axis of said chuck; at least one retaining surface formed in an inner surface of said flat-shaped outer sleeve; a resilient elastic member positioned in said opening in said base; said resilient elastic member being mounted in said opening in said base between a rear surface of opening and said retaining surface formed in said flat-shaped outer sleeve.

2. The container according to claim 1 including protruding ridge portion formed on an inner surface of said outer sleeve; a projecting catch portion formed on an outer surface of said chuck means; said projecting catch portion being formed with a tapering ramp portion; whereby said projecting catch portion may pass over said protruding ridge portion when said chuck means is inserted from the rear of said outer sleeve to catch on said protruding ridge to retain said chuck means in said outer sleeve.

3. The container according to claim 1 in which at least one hole is formed in said chuck ring; at least one projecting boss formed on an inner forward surface of said outer sleeve; said at least one projecting boss engaging said at least one hole in said chuck ring whereby said chuck ring is restrictably slidably attached to a forward end of said outer sleeve.

4. The container according to claim 1 in which said retaining surface comprises an end of a guiding and receiving groove formed on an inner surface of a rear portion of said outer sleeve; said at least one elastic member engaging said guiding and receiving groove.

5. The container according to claim 1 including means forming a deformable elastic strip on a surface of said outer sleeve; a retaining projection formed on an inner end of said deformable elastic strip; and at least one hole formed in said chuck ring; said retaining projection on said deformable elastic strip engaging said hole in said chuck ring; whereby said chuck ring is restrictably slidably retained in a forward end of said outer sleeve.

6. The container according to claim 5 in which said deformable elastic strip is formed by a C-shaped slot cut through said outer sleeve.

7. A stick-shaped material propelling container comprising; a flat-shaped outer sleeve, said outer sleeve having at least one elastic member guiding and receiving groove formed on an inner surface of a rear portion of said outer sleeve, one end of said elastic member guiding and receiving groove acting as a retaining portion; a chuck having a knocking portion inserted into the outer sleeve and having base in the rear portion thereof, said chuck being in the form of elongated tweezers having a pair of opposing flat-shaped arms; a flat-shaped chuck ring connected with a front portion of the outer sleeve and positioned around a front portion of the chuck; a through hole bored through the base of said chuck and extending in a direction perpendicular to a longitudinal direction of said chuck; at least one retaining portion formed on the inner surface of said flat-shaped outer sleeve, and an elastic member mounted between the rear inner surface of said through hole and said retaining portion.

8. The stick-shaped material propelling container according to claim 7 including a protruding ridge portion formed on an inner surface of said outer sleeve; and a tapered projecting portion formed on said chuck; whereby when said tapered projecting portion passes over said protruding ridge portion, said chuck is prevented from slipping out of said flat-shaped outer sleeve.

9. The stick-shaped material propelling container according to claim 7 including at least one retaining projection formed on a forward inner surface of said flat-shaped outer sleeve; and at least one hole in said chuck ring for engaging said at least one retaining projection; whereby said ring is restrictably slidably retained in said flat-shaped outer sleeve.

10. The stick-shaped material propelling container according to claim 7 including at least one C-shaped slot in the surface of said outer sleeve, said C-shaped slot forming at least one deformable elastic strip; an inner deflectable projection formed on an inner surface of said deformable elastic strip; and said chuck ring having at least one hole for receiving said deflectable projection so that said chuck ring is restrictably slidably retained in said outer sleeve.

* * * * *